US011622589B2

(12) United States Patent
Dominguez

(10) Patent No.: US 11,622,589 B2
(45) Date of Patent: Apr. 11, 2023

(54) SEMI-PERMANENT HAIR EXTENSION APPARATUS AND METHOD FOR INSTALLING SAME

(71) Applicant: Brittany Leigh Dominguez, Ponchatoula, LA (US)

(72) Inventor: Brittany Leigh Dominguez, Ponchatoula, LA (US)

( * ) Notice: Subject to any disclaimer, the term of this patent is extended or adjusted under 35 U.S.C. 154(b) by 106 days.

(21) Appl. No.: 16/448,012

(22) Filed: Jun. 21, 2019

(65) Prior Publication Data

US 2019/0387824 A1 Dec. 26, 2019

Related U.S. Application Data

(60) Provisional application No. 62/688,381, filed on Jun. 21, 2018.

(51) Int. Cl.
*A41G 5/00* (2006.01)

(52) U.S. Cl.
CPC ..... *A41G 5/0046* (2013.01); *A41G 5/0073* (2013.01); *A41G 5/008* (2013.01)

(58) Field of Classification Search
CPC ..... A41G 5/00; A41G 5/0013; A41G 5/002; A41G 5/0026; A41G 5/004; A41G 5/0046; A41G 5/0053; A41G 5/006; A41G 5/0006; A41G 5/0066; A41G 5/0073; A41G 5/0086; A41G 3/00; A41G 3/0008; A41G 3/0033
See application file for complete search history.

(56) References Cited

U.S. PATENT DOCUMENTS

2005/0252517 A1* 11/2005 Salinas ..... A41G 5/004 132/201
2006/0180171 A1* 8/2006 Kim ..... A41G 5/006 132/201
2008/0236605 A1* 10/2008 Russo ..... A41G 5/0086 132/201
2013/0167858 A1* 7/2013 Lee ..... A41G 5/0066 132/201

(Continued)

FOREIGN PATENT DOCUMENTS

KR 20060097541 A * 10/2006 ..... A41G 5/00

*Primary Examiner* — Cris L. Rodriguez
*Assistant Examiner* — Karim Asqiriba
(74) *Attorney, Agent, or Firm* — Womble Bond Dickinson (US) LLP

(57) ABSTRACT

The disclosure includes embodiments of a semi-permanent hair extension apparatus and a method or installing the same. The semi-permanent hair extension apparatus can include a plurality of microbeads and a plurality of hair extension wefts. The plurality of microbeads can each include an opening for receiving a plurality of strands of human hair longitudinally therethrough, and a receiving component positioned thereon so as to releasably connect the microbead to a hair extension weft. Each of the plurality of hair extension wefts can include a plurality of strands of hair connected thereto and one or more fastening components positioned thereon and being complementary to each of the one or more receiving components so as to facilitate a removable connection therebetween. The method can include securing a plurality of microbeads to one or more strands of human hair at predetermined intervals and connecting extension wefts to each of the plurality of microbeads.

15 Claims, 4 Drawing Sheets

(56) References Cited

U.S. PATENT DOCUMENTS

| | | | | |
|---|---|---|---|---|
| 2014/0034077 | A1* | 2/2014 | Burchard | A41G 5/0066 132/201 |
| 2015/0083154 | A1* | 3/2015 | Lindsay | A41G 5/0066 132/201 |
| 2018/0146732 | A1* | 5/2018 | Gucciardi | A41G 5/0066 |

* cited by examiner

SEMI-PERMANENT HAIR EXTENSION APPARATUS AND METHOD FOR INSTALLING SAME

CROSS-REFERENCE TO RELATED APPLICATIONS

This application claims priority to, and the benefit of, U.S. Provisional Application No. 62/688,381, filed Jun. 21, 2018, titled "Hair extensions that are applied, bonded and maintained by a licensed cosmetologist, yet can be removed and replaced by the consumer on an everyday basis," which is incorporated herein by reference in its entirety.

BACKGROUND

1. Field of Invention

The present disclosure relates generally to the field of hair extensions and, more particularly, to a semi-permanent hair extension apparatus and a method for installing the same.

2. Description of the Prior Art

Hair extensions are a popular beauty tool to increase hair length and thickness. Permanent or semi-permanent hair extensions can be applied by a professional cosmetologist in a salon for continuous wear, while temporary hair extensions can be applied at home for use for special occasions or on an as-desired basis. Each of these hair extension types has notable drawbacks, however.

Microbead hair extensions, also called microlink or loop hair extensions, are one of the more popular types of permanent hair extensions. These hair extensions are applied by looping small portions of natural hair through dozens, or sometimes even hundreds, of microbeads at various positions along the wearer's scalp, and clamping the microbeads to flatten and secure the microbeads on the natural hair close to the scalp. The physical stress of clamping, as well as the heat applied during the installation process, can be damaging to the natural hair, causing the hair to burn and break. The microbeads have portions of synthetic or real human hair attached thereto, which can make the microbeads heavy and can stress and break the natural hair to which the microbeads are secured. The hundreds of microbeads attached to the wearer's natural hair can also cause headaches if installed too closely to the scalp such that the natural hair is pulled, and can additionally cause discomfort when sleeping as the microbeads may dig into the wearer's head. The significant number of microbeads needed can also limit the wearer's ability to wear her hair up in a ponytail or bun, as the microbeads may be visible on the underside of the wearer's natural hair. Microbead hair extensions must be installed and removed by a professional and are permanent until removed, giving little flexibility for the wearer.

Pre-bonded or fusion hair extensions avoid the need for microbeads, and are installed by bonding clusters (wefts) of synthetic or real human hair to sections of the wearer's natural hair using adhesives such as glue and keratin. This method avoids the issues encountered with microbeads, but requires a lengthy and tedious installation process of several hours, and can be messy and highly damaging to the wearer's hair. Like the microbead extensions, fusion hair extensions must be applied by a professional, and are permanent until removed by the professional.

Clip-in hair extensions are popular for their simplicity; wearers can easily clip wefts of hair into their natural hair at home, and can remove the clip-ins at the end of the day or as desired. This method avoids much of the damage caused by permanent and semi-permanent hair extensions, and minimizes discomfort by allowing the wearer to easily remove the extensions for sleep, exercise, or as otherwise desired. Clip-in hair extensions can be difficult to disguise even when installed correctly, however, and can fall out during wear.

There is lacking a minimally damaging, convenient, and natural-looking hair extension system that can be easily installed and removed, and that can allow for intermittent wear.

SUMMARY

Applicant has recognized the difficulties noted above and that there is an unmet need for a semi-permanent hair extension apparatus that avoids the damage and discomfort of typical permanent hair extensions, and that can be installed and removed easily by the wearer. The present disclosure is directed to a semi-permanent hair extension apparatus and a method for installing the same that provides an elegant solution to these previously unmet needs.

The present disclosure is directed to a semi-permanent hair extension apparatus. According to an embodiment, the apparatus can include a plurality of microbeads and a plurality of hair extension wefts. In an embodiment, each of the plurality of microbeads can include an opening for receiving a plurality of strands of human hair longitudinally therethrough. According to an embodiment, each of the plurality of microbeads can further include a receiving component positioned thereon so as to releasably connect the microbead to a hair extension weft. In an embodiment, the plurality of hair extension wefts can include a plurality of strands of hair connected thereto. In an embodiment, the plurality of hair extension wefts can further include one or more fastening components positioned thereon. According to an embodiment, the one or more fastening components can be complementary to each of the one or more receiving components so as to facilitate a removable connection therebetween.

In an embodiment, the apparatus can further include a band portion. In an embodiment, the band portion can connect two or more of the plurality of hair extension wefts in horizontal series.

In an embodiment, the band portion can include the plurality of hair extension wefts secured to one or more of an upper horizontal surface and a lower horizontal surface thereof.

According to an embodiment, the band portion can include a flexible band selected from any of a mesh, fabric, or elastic material.

In an embodiment, the receiving components and the fastening components can be selected from any of a hook-and-eye closure, a male and female snap, a positive and negative magnet, and a button and button hole.

The present disclosure is also directed to a method for installing a semi-permanent hair extension apparatus. According to an embodiment, the method can include securing each of a plurality of microbeads to one or more strands of human hair proximal to a root of each of the one or more strands of human hair at predetermined intervals as measured latitudinally across a human head. In an embodiment, each of the plurality of microbeads can have a receiving component positioned thereon so as to releasably connect to one or more hair extension wefts. In an embodiment, the method can further include connecting one or more hair extension wefts to each of the plurality of microbeads. According to an embodiment, each of the hair extension wefts can include one or more fastening components positioned thereon. In an embodiment, the one or more fastening components can be positioned to be complementary to each of the one or more receiving components so as to facilitate a removable connection therebetween.

According to an embodiment, the band portion can connect two or more of the plurality of hair extension wefts in horizontal series.

According to an embodiment, the step of connecting one or more hair extension wefts to each of the plurality of microbeads can further include connecting each of the two or more hair extension wefts in series to each of the plurality of microbeads at the predetermined intervals latitudinally across the human head.

In an embodiment, the method can further include repeating the steps of securing the plurality of microbeads to one more strands of human hair at predetermined intervals as measured latitudinally across the human head and connecting each of the two or more hair extension wefts in series to each of the plurality of microbeads at the predetermined intervals latitudinally across the human head at two or more longitudinal levels along the human head so as to create two or more layers of semi-permanent hair weft extensions.

In an embodiment, the two or more longitudinal levels can be selected from any of a first longitudinal level positioned one inch below the occipital bone of the human head, a second longitudinal level positioned one inch above the occipital bone of the human head, and a third longitudinal level positioned one and one-half inches above the ears of the human head.

According to an embodiment, the method can further include sectioning the human hair into a first section positioned above the first longitudinal level, a second section positioned above the second longitudinal level, and a third section positioned above the third longitudinal level. In an embodiment, the method can further include releasing each of the first section, second section, and third section after securing the plurality of microbeads to one or more strands of human hair at predetermined intervals as measured latitudinally across the human head and connecting each of the two or more hair extension wefts in series to each of the plurality of microbeads at the predetermined intervals latitudinally across the human head at each of the first longitudinal level, second longitudinal level, and third longitudinal level, respectively.

In an embodiment, the method can further include identifying that the one or more strands of human hair to which the plurality of microbeads are secured have grown beyond a predetermined length; removing the hair extension wefts from each of the plurality of microbeads; releasing each of the plurality of microbeads from the one or more strands of human hair; re-securing each of the plurality of microbeads to the one or more strands of human hair at a position proximal to the root of each of the one or more strands of human hair; and re-connecting the hair extension wefts to the plurality of microbeads via the fastening components and receiving components.

In an embodiment, the band portion can include the plurality of hair extension wefts secured to one or more of an upper horizontal surface and a lower horizontal surface thereof.

According to an embodiment, the band portion can be a flexible band selected from any of a mesh, fabric, or elastic material.

In an embodiment, the receiving components and the fastening components can be selected from any of a hook-and-eye closure, a male and female snap, a positive and negative magnet, and a button and button hole.

Other aspects and features of the present disclosure will become apparent to those of ordinary skill in the art after reading the detailed description herein and the accompanying figures.

BRIEF DESCRIPTION OF DRAWINGS

Some of the features and benefits of the present disclosure having been stated, others will become apparent as the description proceeds when taken in conjunction with the accompanying drawings, in which.

Figure 1:
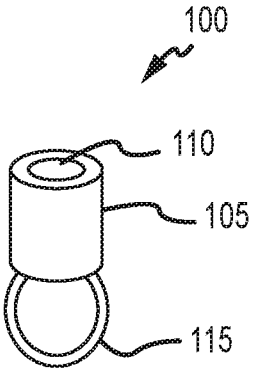
FIG. 1 is a perspective view of a microbead having a receiving component positioned thereon, according to an embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The foregoing aspects, features, and advantages of the present disclosure will be further appreciated when considered with reference to the following description of the following embodiments and accompanying drawings. In describing the following embodiments of the disclosure illustrated in the appended drawings, specific terminology will be used for the sake of clarity. The disclosure, however, is not intended to be limited to the specific terms used, and it is to be understood that each specific term includes equivalents that operate in a similar manner to accomplish a similar purpose. Numerous specific details, examples, and embodiments are set forth and described to provide a thorough understanding of various embodiments of the present invention. However, in certain instances, well-known or conventional details are not described in order to provide a concise discussion of embodiments of the present disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment," "an embodiment," "certain embodiments," or "other embodiments" of the present disclosure are not intended to be interpreted as excluding the existence of additional embodiments that also incorporate the recited features. Furthermore, reference to terms such as "above," "below," "upper," "lower," "side," "front," "back," or other terms regarding orientation are made with reference to the illustrated embodiments and are not intended to be limiting or exclude other orientations.

The present disclosure is directed to a semi-permanent hair extension apparatus and a method for installing the same. Typical microbead hair extensions require dozens to even hundreds of microbeads to be installed at various positions along the wearer's scalp line. These extensions are permanent, and must be installed and removed by a professional. The installation process and use of these extensions is damaging to the wearer's hair, and the microbeads themselves can cause headaches and discomfort for the wearer, particularly during sleep. Applicant recognized these challenges and limitations, and sought to introduce a semi-permanent hair extension apparatus that allows the wearer to selectively install or remove the extensions, and that avoids much of the damage and discomfort of standard microbead extensions.

According to the present disclosure, a semi-permanent hair extension apparatus is described that includes a plurality of microbeads and a plurality of hair extension wefts. Unlike standard microbead extensions, however, the plurality of microbeads utilized according to an embodiment of the presently described apparatus can be limited to around 12-18 microbeads. In other embodiments, fewer than 12 or greater than 18 microbeads may be utilized, for example depending on the thickness of the wearer's hair or desired effect of the extensions, as will be readily understood by one of ordinary skill in the art.

FIG. 1 illustrates an example 100 of a microbead 105, according to an embodiment. In some embodiments, each of the plurality of microbeads 105 can be cylindrical in shape, with a cylindrical body including an opening 110 extending vertically therethrough for receiving a plurality of strands of human hair longitudinally therethrough.

Each microbead 105 can be installed by gathering a small grouping of human hair, for example with a hook, and inserting the human hair downwardly through the opening 110. The microbead 105 can then be slid upwards along the length of the grouping of human hair such that the microbead 105 is positioned proximate the roots of the human hair, close to the wearer's scalp. A person of ordinary skill in the art will recognize the need to position the microbead 105 close enough to the roots to maximize longevity of wear, while avoiding excessive stress or pulling on the wearer's scalp. When the appropriate positioning is achieved, the microbead 105 can be clamped, for example using pliers, to close the opening 110 and flatten the microbead 105 around the grouping of human hair to secure the microbead 105 to the human hair at the desired location. In this way, the microbead 105 will be secured to the wearer's natural hair and will remain in place as the wearer's hair grows out from the root.

At a certain point and after a certain amount of outgrowth has occurred, it may be determined that the one or more strands of human hair to which the plurality of microbeads 105 are secured have grown beyond a predetermined length. The wearer can then return to a salon professional to have the microbeads 105 unclamped, moved up towards the roots of the hair, and re-clamped. Otherwise, the microbeads 105 will stay permanently attached to the wearer's hair until removed by a professional hair stylist.

The microbeads 105 may be formed of any suitable material, as will be readily understood by one of ordinary skill in the art. For example, the microbeads 105 may be formed of a plastic, metal, or other polymer or resin material suitable for the defined purpose. The microbeads 105 can be formed of a material sufficiently rigid to hold its shape, but malleable enough to allow the microbeads 105 to be clamped around the natural hair to secure the microbeads 105 in place, and to be unclamped and re-clamped to account for outgrowth.

As illustrated in FIG. 1, each of the microbeads 105 can also include a receiving component 115 positioned thereon so as to releasably connect the microbead 105 to one or more hair extension weft. Typical microbeads will have hair wefts connected thereto, so that the hair weft is permanently attached to the wearer's natural hair. By instead arranging a receiving component 115 on the microbead 105, the present disclosure allows the hair weft to be easily and selectively installed and removed by the wearer at will.

In the illustrated example, the receiving component 115 is a circular loop positioned at a lower portion of the microbead 105. In this configuration, the receiving component 115 is positioned to receive a hook through the central opening therein, so as to form a hook-and-eye closure between the receiving component 115 and a fastening component of a hair extension weft. In other examples, the receiving component 115 can include any suitable coupling or connecting component, such as a button, snap, or magnet. Other connecting components are also contemplated, such as a screw connection or any other suitable means, as will be readily understood by one of ordinary skill in the art. For example, the receiving component 115 may be the female portion of a snapping closure, and the fastening component of the hair extension weft may be the male portion of a snapping closure, so that the receiving component 115 of the microbead 105 and the fastening component of the hair extension weft can removably connect together. In another example, the receiving component 115 can be a button, and the fastening component of the hair extension weft can be a button hole, such that the button of the receiving component 115 can be inserted into and through the button hole of the fastening component to secure the receiving component 115 of the microbead 105 to the fastening component of the hair extension weft. Other various receiving and fastening component combinations are contemplated, as will be readily understood by one of ordinary skill in the art.

In the illustrated example, the receiving component 115 is positioned at a lower portion of the microbead 105, and is positioned to extend vertically down from the lower portion of the body of the microbead 105. In this configuration, the weight of the fastening component and hair extension weft can be evenly distributed on the body of the microbead 105, and in turn on the natural hair secured through the opening 110 of the microbead 105. This configuration also allows the loop of the receiving component 115, in the illustrated example, to be positioned to lie flat against the wearer's head, such that discomfort during sleep can be minimized. Such positioning can also help to obscure the appearance of the microbeads 105 through the wearer's natural hair. In other examples, the loop of the receiving component 115 may be positioned on a side or upper portion of the body of the microbead.

In examples where a button, snap, or magnet connection is utilized, the receiving component 115 may be positioned on a front surface of the body of the microbead 105. For example, the female portion of a snap closure can be positioned to extend from a front face of the body of the microbead 105, such that the male portion of a snap closure, positioned on a front face of the fastening component of the hair extension weft, can be brought into proximity with the male portion of the snap closure and can be releasably connected thereto. When connected, the snap connection between the receiving component and the fastening component can lie flat against the wearer's head so as to minimize discomfort and visibility.

Figure 2:
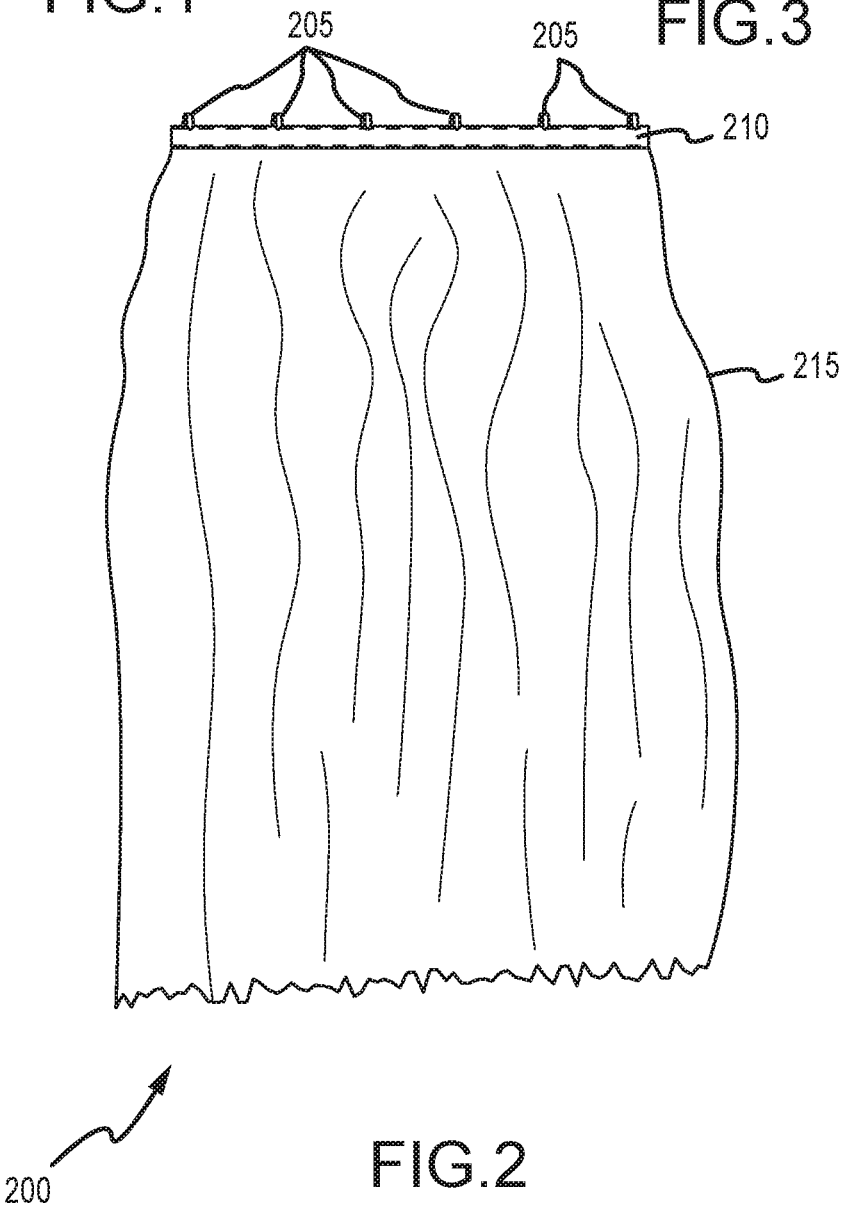
FIG. 2 is a perspective view of a plurality of hair extension wefts connected in horizontal series by a band portion and having a plurality of fastening components positioned thereon, according to an embodiment.

FIG. 2 illustrates an example 200 of a plurality of hair extension wefts 215 connected in horizontal series by a band portion 210. A plurality of strands of natural or synthetic hair can be gathered to form the plurality of hair extension wefts 215. In some examples, the plurality of hair extension wefts 215 can be secured only along an upper horizontal surface of the band portion 210, while in other examples, the plurality of hair extension wefts 215 can be secured only along a lower horizontal surface of the band portion 210, and in still other examples, the plurality of hair extension wefts 215 can be secured along both upper and lower horizontal surfaces of the band portion 210. Such selections can be made based on desired hair thickness and appearance.

The band portion 210 can be formed of any suitable material, as will be readily understood by one of ordinary skill in the art. For example, the band portion 210 can be formed of any mesh, fabric, or elastic material, or any other suitable material. In some examples, the band portion 210 can be formed of a flexible or stretchy material, while in the other examples, the band portion 210 can be formed of a rigid or semi-rigid material. In some examples, the band portion 210 can be colored to blend in with the wearer's hair, while in other examples, the band portion 210 can be colored to blend in with the wearer's scalp. The plurality of hair extension wefts 215 can be attached to the band portion 210 by any known suitable means, such as by sewing, gluing, stapling, or other connection means as will be readily understood by one of ordinary skill in the art. The amount, thickness, and length of the plurality of hair extension wefts 215 attached to the band portion 210 can be selected based on the wearer's own hair texture, color, thickness, and desired appearance.

A horizontal length of the band portion 210 may be selected based on measurements of the wearer's head. For example, the band portion 210 can be measured and formed to fit along first, second, and third longitudinal levels on the wearer's head. The first longitudinal level may be measured latitudinally across the wearer's head from a position at or about one inch below the occipital bone of the wearer's head. The second longitudinal level may be measured latitudinally across the wearer's head from a position at or about one inch above the occipital bone of the wearer's head. The third longitudinal level may be measured latitudinally across the wearer's head from a position at or about one and one-half inches above the ears of the wearer's head. In other embodiments, the first, second, and third longitudinal levels may be positioned above or below the recited positions on the users head; for example the first longitudinal level may be positioned less than one inch below the occipital bone of the wearer's head, or may be positioned more than one inch below the occipital bone of the wearer's head. The second and third longitudinal levels may similarly be adjusted to be lesser or greater than the indicated measurements. In various embodiments, fewer or greater than three longitudinal levels may be utilized. A person having ordinary skill in the art will readily understand that the relative positioning of each of the one or more longitudinal levels on the wearer's head may be selected based on the wearer's individual head size and shape, hair length and thickness, and desired appearance. A typical length for the band portion 210 extending across the second longitudinal level will be about six inches, and a typical length for the band portion 210 extending across the third longitudinal level will be about twelve inches. Actual lengths of each band portion 210 will vary based on individual wearers' head shapes, sizes, hair patterns, and the like, as will be readily understood by one of ordinary skill in the art.

As illustrated in the embodiment of FIG. 2, the band portion 210 can include one or more fastening components 205 positioned in horizontal series thereon. The fastening components 205 can be complementary to the one or more receiving components 115 positioned on the microbeads 105, such that the hair extension wefts of the band portion 210 can be removably connected to the microbeads attached to the wearer's natural hair.

Figure 3:
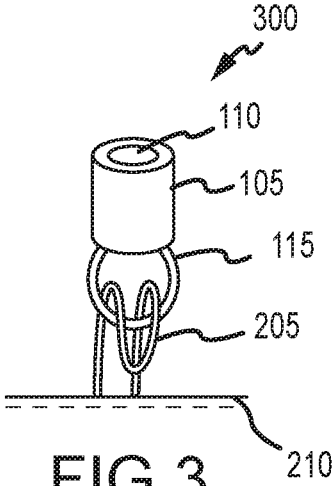
FIG. 3 is a partial perspective view of a hook-and-eye fastening component connected to a complementary hook-and-eye receiving component of a microbead, according to an embodiment.

FIG. 3 illustrates an embodiment 300 in which the receiving components 115 are loops and the fastening components 205 are hooks such that the fastening components 205 can be removably connected to the receiving components 115 in the nature of a hook-and-eye closure. In other embodiments, as discussed above, the receiving components 115 and the fastening components 205 can be any combination of male and female snap closures, buttons and button holes, magnets, or the like, as will be readily understood by one of ordinary skill in the art.

The number and relative placement of the fastening components 205 along the length of the band portion 210 may be directly proportional to the number and placement of the microbeads 105 on the wearer's head, according to embodiments. In the illustrated example, six fastening components 205 are evenly spaced along the length of the band portion 210. This number and spacing may be directly proportional to the position and spacing of each of six microbeads 105 positioned on the wearer's head, such that the fastening components 205 align with and connect to the receiving components 115 of the microbeads 105 when brought into close proximity therewith, according to the illustrated embodiment. This arrangement allows multiple hair extension wefts, connected by a single band portion, to be easily installed and removed by the wearer without professional assistance and with lesser damage to the hair than standard hair extension systems. This installation method provides the convenience of clip-in hair extensions, but with the security and superior appearance of permanent microbead extensions. In other embodiments, fewer or greater than the illustrated six fastening components 205 may be included on the band portion 210. Additionally, the relative spacing between each of the fastening components 205 along the length of the band portion 210 may vary, as will be readily understood by one of ordinary skill in the art.

Although illustrated as connected by a single band portion 210, in other embodiments the plurality of hair extension wefts 215 may be independently connected to individual fastening components 205. In such an embodiment, each hair extension weft 215 and associated fastening component 205 can be connected to a receiving component 115 on a microbead 105 secured to the wearer's natural hair.

Figure 4:
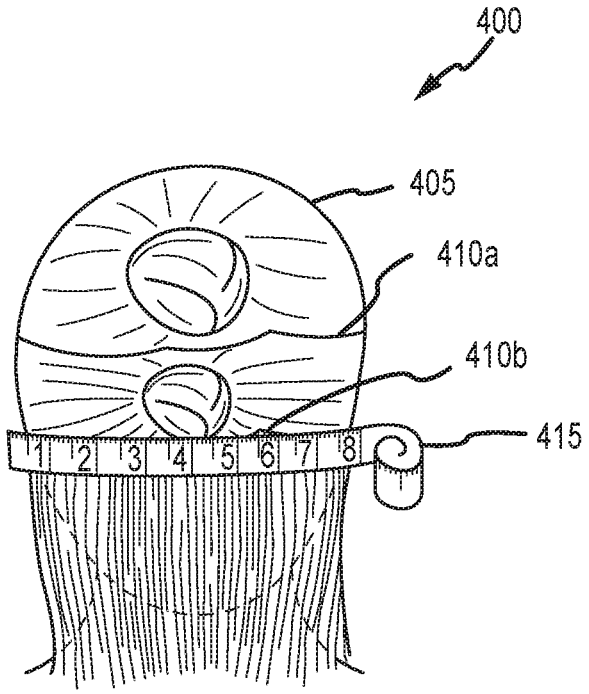
FIG. 4 is a perspective view of a first step in a method for installing a semi-permanent hair extension apparatus, the first step including measuring latitudinally across a human head to determine intervals at which a plurality of microbeads are to be installed, according to an embodiment.

FIGS. 4-8 illustrate steps 400-800 in an example embodiment of a method for installing a semi-permanent hair extension apparatus. In a first step 400 of the method, according to an embodiment, the wearer's natural hair may be divided into three sections, as illustrated in FIG. 4. For example, the wearer's natural hair may be sectioned latitudinally across the wearer's skull 405 at a first longitudinal level 410*c* and secured. A second section of hair may be sectioned latitudinally across the wearer's skull 405 at a second longitudinal level 410*b* and secured, and a third section of hair may be sectioned latitudinally across the wearer's skull 405 at a third longitudinal level 410*a* and secured. In other embodiments, the wearer's natural hair may be sectioned into fewer or greater than three longitudinal levels, depending on the wearer's hair thickness, volume, texture, and the like, as will be readily understood by one of ordinary skill in the art.

As illustrated in FIG. 4, the method may include measuring across the wearer's skull 405 at each longitudinal level 410*a*, 410*b*, 410*c* so as to determine a length at which the band portion 210 should be formed for each corresponding longitudinal level 410*a*, 410*b*, 410*c*. For example, the first longitudinal level 410*c* may be positioned about one inch below the occipital bone of the wearer's skull 405, and may be about five inches in length, although the length may be lesser or greater than four inches, depending on the wearer's individual skull size. The second longitudinal level 410*b* may be positioned about one inch above the occipital bone of the wearer's skull 405, and may be about six inches in length, although the length may be lesser or greater than six inches, depending on the wearer's individual skull size. The third longitudinal level 410*a* may be positioned about one and one-half inches above the wearer's ears, and may be about twelve inches in length, although the length may be lesser or greater than twelve inches, depending on the wearer's individual skull size. In other embodiments, the longitudinal levels 410*a*, 410*b*, 410*c* may be positioned at other positions along a longitudinal length of the wearer's skull 405, depending, for example, on skull size, hair thickness, desired appearance, and the like, as will be readily understood by one of ordinary skill in the art.

Although measurement of only the second longitudinal level 410*b* is illustrated in FIG. 4, the method may include measuring each of the first, second, and third longitudinal levels 410*a*, 410*b*, 410*c*. A flexible measuring tape 415 may be utilized to measure the levels in some examples, while other measurement means may be utilized in other embodiments, as will be readily understood by one of ordinary skill in the art.

Figure 5:
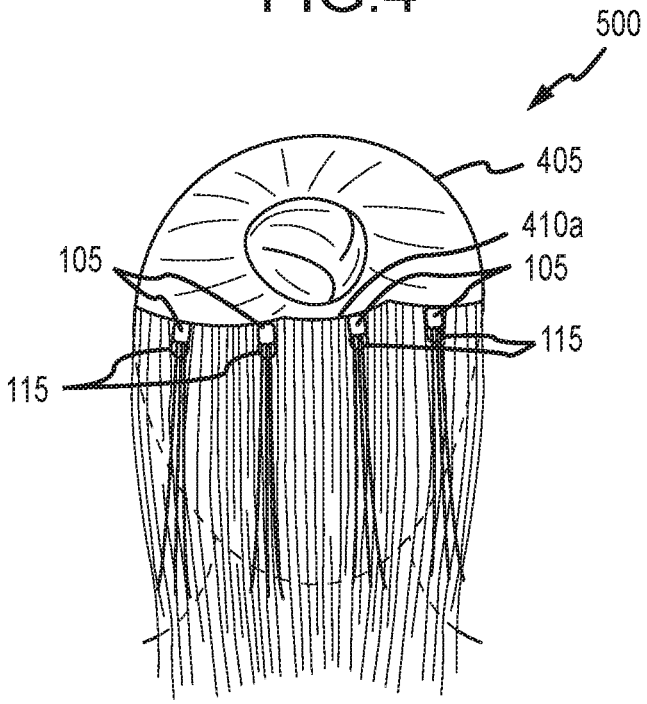
FIG. 5 is a perspective view of a second step in a method for installing a semi-permanent hair extension apparatus, the second step including securing each of a plurality of microbeads to one or more strands of human hair proximal to a root of each of the one or more strands of human hair at predetermined intervals as measured latitudinally across a human head, according to an embodiment.

In FIG. 5, the step 500 of installing the plurality of microbeads 105 is illustrated, according to an embodiment. As illustrated, the plurality of microbeads 105 may be installed at predetermined intervals latitudinally across the wearer's skull 405 at each of the three longitudinal levels 410*a*, 410*b*, 410*c*. The predetermined intervals at which the microbeads 105 are installed may coincide with the spacing of the fastening components 205 positioned along the length of the band portion 210 connecting the plurality of hair extension wefts 215.

In the example illustrated in FIG. 5, four microbeads 105 may be secured along the third longitudinal level 410*a*. In other embodiments, fewer or greater than four microbeads 105 may be installed at any of the first, second, or third longitudinal levels 410*a*, or at any one or more longitudinal levels positioned on the wearer's skull 405. Placement and number of microbeads 105 may vary among different wearers based on varying head shapes and sizes, hair thicknesses, and desired appearance. Placement and number of microbeads 105 may also vary at different longitudinal levels on a single wearer's skull, based on position on the wearer's skull 405. For example, latitudinal levels above the wearer's occipital bone will be longer than longitudinal levels below the occipital bone and therefore may require a greater number of microbeads. Placement and number of microbeads 105 may also vary based on relative hair thickness at various positions and the like, as will be readily understood by one of ordinary skill in the art.

Although illustrated in FIG. 5 only at the second longitudinal level 410*b*, the method may include securing a plurality of microbeads 105 at each of the three longitudinal levels 410*a*, 410*b*, 410*c*, at the predetermined intervals across the wearer's skull 405, according to the illustrated embodiment. In the illustrated embodiment, a total of 12-15 microbeads 105 may be secured, although fewer or greater than 12-15 microbeads may be secured according to various individual wearers' physiology and desired appearance.

Figure 6:
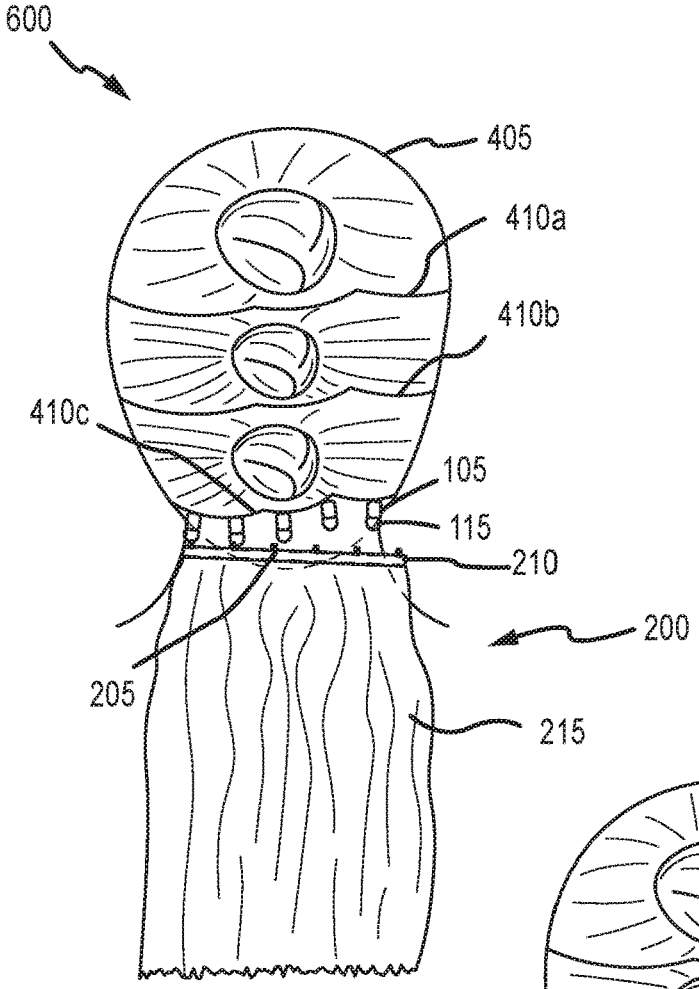
FIGS. 6-8 are perspective views of a third step in a method for installing a semi-permanent hair extension apparatus, the third step including connecting one or more hair extension wefts to each of a plurality of microbeads, each of the hair extension wefts having one or more fastening components positioned thereon, the one or more fastening components positioned to be complementary to each of one or more receiving components positioned on each of the plurality of microbeads so as to facilitate a removable connection therebetween, according to an embodiment.
Figure 7:
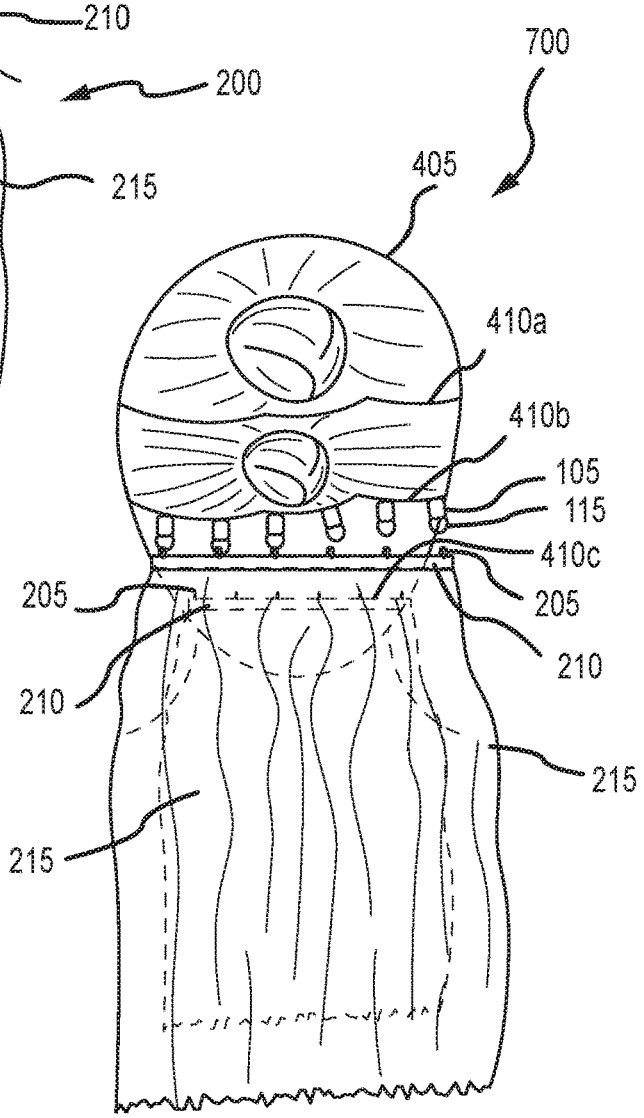
Figure 8:
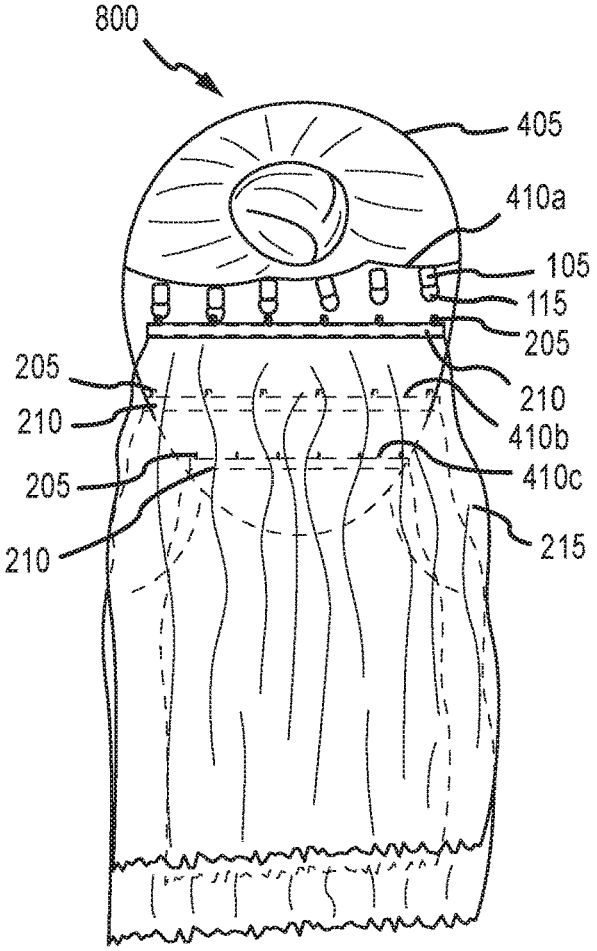

FIGS. 6-8 illustrate the next steps 600-800 in the illustrated method for installing the semi-permanent hair extension apparatus. According to FIG. 6, the method 600 can include connecting one or more hair extension wefts 215 to each of the plurality of microbeads 105 by connecting the one or more fastening components 205, to which the one or more hair extension wefts 215 are secured, to the one or more receiving components 115, which are secured to the one or more microbeads 105. In the illustrated embodiment, the connections between the fastening components 205 and the receiving components 115 form hook-and-eye closures, while in other embodiments the connections may be formed by male and female snap closures, buttons and button holes, magnets, or the like, as will be readily understood by one of ordinary skill in the art.

In the embodiments illustrated in FIGS. 6-8, the one or more hair extension wefts 215 are secured to a band portion 210, and the one or more fastening components 205 are likewise secured along the length of the band portion 210. In other embodiments, the hair extension wefts 215 may be individually or in groups secured to one or more fastening components 205 in the absence of a band portion 210, such that the hair extension wefts 215 may be individually or in groups secured to the receiving components 115 of the microbeads 105 via their associated fastening components 205.

For ease of installation, connecting the fastening components 205 to the receiving components 115 in order to secure the hair extension wefts 215 to the microbeads 105 may first be done at the first longitudinal level 410*c*, then at the second longitudinal level 410*b*, and finally at the third longitudinal level 410*a*, as illustrated in FIGS. 6, 7, and 8. In this way, the wearer's natural hair can be released between each longitudinal level after the associated hair extension wefts 215 have been installed. In other embodiments, the hair extension wefts 215 may be installed in any varying order as will be readily understood by one of ordinary skill in the art.

Figure 9:
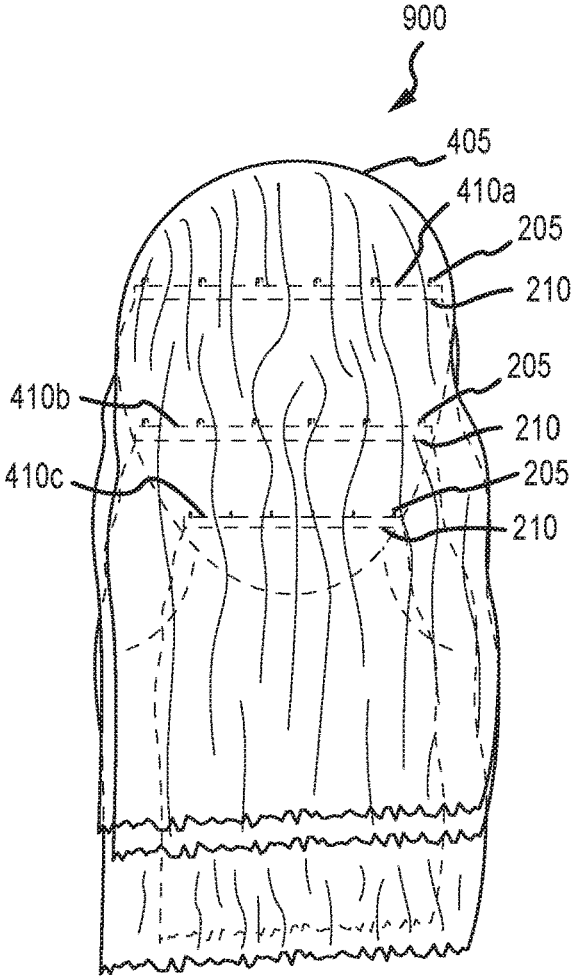
FIG. 9 is a perspective view of a human head after a semi-permanent hair extension apparatus has been installed, according to an embodiment.

FIG. 9 illustrates the finished product 900, in which three band portions 210 of hair extension wefts 215 have been installed on the wearer's skull 405. The wearer's natural hair has been released between and over each of the band portions 210 so that the band portions 210 are covered and concealed by the wearer's natural hair, and the hair extension wefts 215 are allowed to blend in with the wearer's natural hair.

Steps 600, 700, and 800, as illustrated in FIGS. 6-8, may be easily performed by a wearer at home, without the need for professional installation. Once a professional has secured the microbeads 105 as discussed with respect to FIG. 5, the wearer can easily install the hair extension wefts 215 by securing the plurality of fastening components 205 to the corresponding plurality of receiving components 115, and can easily remove the hair extension wefts 215 by uncoupling the plurality of fastening components 205 from the corresponding plurality of receiving components 115. For example, the wearer may connect the hair extension wefts 215 for desired wear, and remove the hair extension wefts 215 to wash the hair extension wefts 215, for sleep, or to allow for adjustment of the microbeads 105 by the hairstylist to account for outgrowth, as discussed in detail above. In this way, the present disclosure provides a semi-permanent hair extension apparatus that affords the appearance and security of permanent hair extensions, with the ease and flexibility of temporary hair extensions.

This application claims priority to, and the benefit of, U.S. Provisional Application No. 62/688,381, filed Jun. 21, 2018, titled "Hair extensions that are applied, bonded and maintained by a licensed cosmetologist, yet can be removed and replaced by the consumer on an everyday basis," which is incorporated herein by reference in its entirety.

What is claimed is:

1. A semi-permanent hair extension apparatus, the apparatus comprising:
- a plurality of microbeads, each of the plurality of microbeads having:
  - a body including an upper portion and a lower portion,
  - an opening extending through the body for receiving a plurality of strands of human hair longitudinally extending therethrough, so that each one of the plurality of microbeads is clamped close to a wearer's scalp when the plurality of strands of human hair extend therethrough, and
  - a circular hollow receiving component having two separate end portions spaced apart, each of the end portions connected to the lower portion of the body so that the circular hollow receiving component is substantially evenly distributed along the lower portion of the body;
- a hair extension weft configured to be removably connected to the plurality of microbeads and having a plurality of strands of hair connected thereto; and
- one or more fastening components connected to the hair extension weft and positioned spaced apart and extending upwardly from an upper portion of the hair extension weft thereby to removably connect to the hair extension weft to the circular hollow receiving component of one or more of the plurality of microbeads, each of the one or more fastening components being complementary to a respective one or more receiving components, so that a weight of a combination of one or more fastening components and the hair extension weft is evenly distributed on the body of each of the plurality of microbeads when positioned thereon so as to lie flat against a wearer's head and visually obscure an appearance of the plurality of microbeads.

2. The semi-permanent hair extension apparatus of claim 1, wherein the hair extension weft comprises a first hair extension weft, and wherein the apparatus further comprises one or more additional hair extension wefts, each configured to be removably connected to the plurality of microbeads.

3. The semi-permanent hair extension apparatus of claim 2, wherein the first hair extension weft and the one or more additional hair extension wefts individually or in groups connect to the one or more fastening components.

4. The semi-permanent hair extension apparatus of claim 1, wherein the receiving components of each of the plurality of microbeads and the one or more fastening components are selected from an interlocking pair of components comprising one or more of: a hook-and-eye closure, a male and female snap, a positive and negative magnet, a button and button hole, or a screw connection, wherein each respective corresponding interlocking portion of the interlocking pair of components is positioned on a front face of the body of the one or more receiving components and on the front face of the one or more fastening components of the hair extension weft.

5. The semi-permanent hair extension apparatus of claim 1, wherein the circular hollow receiving component having the two separate end portions spaced apart are connected to one of an outer diameter or an inner diameter of the lower portion of the body portion.

6. A semi-permanent hair extension apparatus, the apparatus comprising:
- a plurality of microbeads, each of the plurality of microbeads having:
  - a body including an upper portion and a lower portion,
  - an opening extending through the body for receiving a plurality of strands of human hair longitudinally extending therethrough, so that each one of the plurality of microbeads is clamped close to a wearer's scalp when the plurality of strands of human hair extend therethrough, and
  - a circular hollow receiving component having two separate end portions spaced apart, the end portions connected to the lower portion of the body so that the circular hollow receiving component is substantially evenly distributed along the body;
- a hair extension weft to be removably connected to the plurality of microbeads and having a plurality of strands of hair connected thereto;
- a band connected to and positioned to support the hair extension weft; and
- one or more fastening components connected to the band and positioned spaced apart and extending upwardly from the band thereby to connect to the circular hollow receiving component to the hair extension weft, each of the one or more fastening components being complementary to a respective one or more receiving components, so that a weight of a combination of one or more fastening components and the hair extension weft is evenly distributed on the body of each one of the plurality of microbeads when positioned thereon so as to lie flat against a wearer's head and visually obscure an appearance of the plurality of microbeads.

7. The semi-permanent hair extension apparatus of claim 6, wherein the hair extension weft comprises a first hair extension weft, and wherein the apparatus further comprises one or more additional hair extension wefts, each to be removably connected to the plurality of microbeads.

8. The semi-permanent hair extension apparatus of claim 6, wherein the hair extension weft is connected to the band at: (a) an upper horizontal surface, (b) a lower horizontal surface, or (c) both of the upper horizontal surface and the lower horizontal surface.

9. The semi-permanent hair extension apparatus of claim 8, wherein the band comprises one or more of: (a) a flexible band selected from any of a mesh, fabric, or elastic material, or (b) a semi-rigid or a rigid material.

10. The semi-permanent hair extension apparatus of claim 6, wherein the one or more receiving components and the one or more fastening components are selected from an interlocking pair of components comprising one or more of: a hook-and-eye closure, a male and female snap, a positive and negative magnet, a button and button hole, or a screw connection, wherein each respective corresponding interlocking portion of the interlocking pair of components is positioned on a front face of the body of the one or more receiving components and on the front face of the band of the one or more fastening components.

11. The semi-permanent hair extension apparatus of claim 6, wherein the circular hollow receiving component having the two separate end portions spaced apart are connected to one of an outer diameter or an inner diameter of the lower portion of the body portion.

12. A semi-permanent hair extension apparatus, the apparatus comprising:

a plurality of microbeads, each of the plurality of microbeads having:

a body including an upper portion and a lower portion, an opening extending through the body for receiving a plurality of strands of human hair longitudinally extending therethrough, so that each one of the plurality of microbeads is clamped close to a wearer's scalp when the plurality of strands of human hair extend therethrough, and a circular hollow receiving component having two separate end portions spaced apart connected to and extending vertically downward from one of the outer diameter or inner diameter of the lower portion of the body and a medial portion extending between the two separate end portions so that the circular hollow receiving component is substantially evenly distrusted along the lower portion of the body;

a hair extension weft to be removably connected to the plurality of microbeads and having a plurality of strands of hair connected thereto;

a band connected to and positioned to support the hair extension weft; and one or more fastening components connected to the band and positioned spaced apart and extending upwardly from the band thereby to connect to the circular hollow receiving component to the hair extension weft, each of the one or more fastening components being complementary to a respective one or more receiving components, so that a weight of a combination of the one or more fastening components and the hair extension weft is evenly distributed on the body of each one of the plurality of microbeads when positioned thereon so as to lie flat against a wearer's head and visually obscure an appearance of the plurality of microbeads.

13. The semi-permanent hair extension apparatus of claim 12, wherein the circular hollow receiving component comprises a circular loop having separate end portions connected to and extending down from the one of an outer diameter or an inner diameter of the lower portion of the body, and wherein the one or more fastening components comprises a hook, the hook connected on a front face of the hair extension weft and extends inwardly to engage and interlock with the circular loop.

14. The semi-permanent hair extension apparatus of claim 13, wherein the hair extension weft comprises a first hair extension weft, and wherein the apparatus further comprises one or more additional hair extension wefts, each to be removably connected to the plurality of microbeads.

15. The semi-permanent hair extension apparatus of claim 13, wherein the hair extension weft is connected to the band at: (a) an upper horizontal surface, (b) a lower horizontal surface, or (c) the upper horizontal surface and the lower horizontal surface.

* * * * *